US007108582B2

(12) United States Patent
Sato et al.

(10) Patent No.: US 7,108,582 B2
(45) Date of Patent: Sep. 19, 2006

(54) POLISHING MACHINE

(75) Inventors: Satoru Sato, Tokyo (JP); Jun Tamura, Tokyo (JP); Jun Watanabe, Tokyo (JP)

(73) Assignee: Nihon Microcoating Co., Ltd., Tokyo (JP)

( * ) Notice: Subject to any disclaimer, the term of this patent is extended or adjusted under 35 U.S.C. 154(b) by 0 days.

(21) Appl. No.: 11/303,207

(22) Filed: Dec. 15, 2005

(65) Prior Publication Data

US 2006/0094343 A1 May 4, 2006

Related U.S. Application Data

(63) Continuation-in-part of application No. PCT/JP2005/007436, filed on Apr. 19, 2005.

(51) Int. Cl.
*B24B 49/00* (2006.01)

(52) U.S. Cl. ..... 451/11; 451/5; 451/8; 451/9; 451/41; 451/296

(58) Field of Classification Search ..... 451/5, 451/8, 9, 11, 41, 10, 300, 296, 303, 285–290
See application file for complete search history.

(56) References Cited

U.S. PATENT DOCUMENTS 6,290,570 B1 * 9/2001 Heesemann ..... 451/5
6,402,596 B1 * 6/2002 Hakomori et al. ..... 451/44
6,454,631 B1 * 9/2002 Buzzetti ..... 451/11
6,824,446 B1 * 11/2004 Ang et al. ..... 451/6

* cited by examiner

*Primary Examiner*—Lee D. Wilson
*Assistant Examiner*—Anthony Ojini
(74) *Attorney, Agent, or Firm*—Beyer Weaver & Thomas LLP

(57) ABSTRACT

A polishing machine uses a polishing head having a movable pad to press a polishing tape for polishing beveled and edge parts of a disk-shaped object. A rotary shaft is connected to the polishing head in a direction of contact surface between the polishing tape and the object. A rotary-and-reciprocating motion device rotates the polishing head around the axial line of the rotary shaft and moves it reciprocatingly along its axial line. A moving device undergoes a reciprocating motion perpendicularly to the object surface while supporting the object. When in use, the polishing head is rotated while the pad causes the polishing tape to protrude from it while the object is rotated.

8 Claims, 7 Drawing Sheets

POLISHING MACHINE

This application is a continuation of International Application No. PCT/JP2005/007436, filed Apr. 19, 2005 which claims priority on Japanese Patent Application 2004-124696 filed Apr. 20, 2004.

BACKGROUND OF THE INVENTION

This invention relates to a polishing machine for polishing edges and portions near the edges of a target object by using a polishing tape and more particularly to such a polishing machine adapted to carry out the polishing by contacting the polishing tape to the target object without bending the polishing tape more than necessary.

A thin film is formed as shown in FIG. 10A on the surface of a target object to be polished such as a semiconductor wafer (indicated by letter W) but it is something to be removed because the thin film at beveled portions (indicated by letter B) along an edge or that on an edge section (indicated by letter E) on a circumference inside such a beveled portion tends to be a source of particles or contaminations of other forms. Particles are also likely to be generated from rough spots developed at beveled potions of a semiconductor device, depending on its production process, and it is coming to be considered necessary to improve the surface accuracy of portions from which a thin film has been removed.

For removing unnecessary portions of a thin film, it has been known to use the method of firstly forming a protective membrane on the surface of a semiconductor wafer and then to remove the film from beveled and edge portions by etching. Japanese Patent Publications Tokkai 2002-208572 and 2003-234314 have disclosed apparatus for removing a film from such places by using a polishing tape instead of by etching. By such an apparatus, an unnecessary membrane is removed by passing a polishing tape from the upper surface of a semiconductor wafer to an edge part and further down to the bottom surface and pressing it onto the semiconductor wafer by means of a polishing head.

Methods of removing a film from such a portion without using a polishing tape have also been developed, such as disclosed in Japanese Patent Publication Tokkai 2002-329687. By a method of removing a film by etching, on the other hand, there are situations where the etching rate becomes very slow such that the throughput becomes lower, depending on the kind of the film. Moreover, the apparatus must be resistant against chemicals that are used for the etching process, and the disposal of the waste liquid becomes necessary after the removal.

Use of a polishing tape does not accompany the kind of problems encountered when a film is removed by etching but the polishing tape must be bent to a significant degree in order to press it along the edge of a semiconductor tape because the thickness of the wafer is less than 1 mm.

Polishing tapes have a polishing layer containing a polishing material formed on a base sheet material. If such a polishing tape is bent excessively, the polishing layer comes to be separated and this generates particles and causes contamination.

If a polishing tape is bent in this manner as it is contacted to the edge portion of a semiconductor wafer, furthermore, it nearly becomes a point contact and the whole surface of the polishing tape cannot be effectively used for the polishing. If the width of the polishing tape is reduced in order to use it efficiently, it becomes easier to break and more polishing machines would be required for maintaining a high efficiency.

Polishing machines of the type not using any polishing tapes are adapted to use a dedicated special polishing material for removing a film at beveled and edge parts of semiconductor wafers and they have very complicated structures.

Japanese Patent Publications Tokkai 7-164301 and 8-174399 disclose polishing machines of the type having a polishing head that uses a polishing tape to polish end parts of a semiconductor wafer. Although they are adapted to rotatably support a semiconductor wafer, they cannot move in the perpendicular direction and hence cannot be used for polishing edge portions.

SUMMARY OF THE INVENTION

It is therefore an object of this invention to provide a polishing machine capable of polishing beveled parts and edge portions of a semiconductor wafer by using a polishing tape.

It is another object of this invention to provide such a polishing machine which does not cause any secondary contamination due to the polishing tape that is used.

It is still another object of this invention to provide such a polishing machine with which the whole width of the polishing tape contributes to the polishing.

A polishing machine according to this invention is characterized as comprising a polishing head for contacting a polishing tape to a disk-shaped target object to be polished, a pad that is movably provided to the polishing head and serves to press the polishing tape onto the target object, a rotary shaft that is connected to the polishing head in a direction of a contact surface between the polishing tape and the target object, a rotary-and-reciprocating motion device adapted to rotate the polishing head around the axial line of the rotary shaft and to move the polishing head reciprocatingly along its axial line, and a moving device adapted to undergo a reciprocating motion perpendicularly to the main surface of the disk-shaped target object while supporting the target object.

When the surface of the target object is polished, the rotary-and-reciprocating motion device rotates the polishing head and the moving device moves the target object such that the pad is moved outward to cause the polishing tape to protrude and to thereby come to contact the target object over the contact surface.

In the above, the polishing tape may comprise a base sheet material and a polishing layer formed on the base sheet material, or may be in the form of a pad. At the time of the polishing, use may be made of a polishing liquid or a chemical for chemical mechanical polishing.

The moving device may be adapted to move the target object parallel to the contact surface to thereby adjust position of the contact surface with respect to the polishing tape. It may preferably include a rotating device for rotating the target object around its center, the rotating device having a rotary shaft part that is rotated by a driving part and a rotary support part that contains the rotary shaft part inside and has a support surface for supporting the target object, the rotary support part rotating with the rotary shaft part and engaging the rotary shaft so as to be movable axially.

There may be included means that is engaged with a bottom part of the rotary support part for moving the rotary support part reciprocatingly in a direction perpendicular to the support surface. Such means may include a cam that engages with the bottom part and a cam rotating means for rotating the cam.

The rotary-and-reciprocating motion device rotating said polishing head and said moving device moving said target object when said contact surface of said target object is polished such that said pad is moved outward to cause said polishing tape to protrude and to thereby come to contact said target object over said contact surface.

The rotary-and-reciprocating motion device may preferably include a rotary member that contains the rotary shaft inside so as to be movable in an axial direction and is rotatable together with the rotary shaft by a rotating means. The rotary shaft may be provided with means for moving the rotary shaft reciprocatingly in an axial direction. Such means is not movable along the axis of the rotary shaft and may comprise two rotary plates which are rotatable, a cam which is positioned between and in contact with these two rotary plates and a rotary driver for rotating the cam.

The polishing head may include two mutually parallel plates and a roller that is rotatably supported between the two plates, the polishing tape being adapted to run over the roller and the pad being adapted to move by an air cylinder provided to at least one of these plates.

Since a polishing machine of this invention uses a polishing tape for the polishing, there is no problem associated with machines for chemical mechanical polishing such as resistance against chemicals. Moreover, since the pad is made to move outward so as to push the polishing tape outward for contacting the target object to be polished, the polishing tape need not be bent to any extreme degree. Since the polishing head is caused to undergo reciprocating motion while the polishing tape and the target object remain in contact with each other, the whole surface of the polishing tape is made to contribute to the polishing for improved efficiency.

DETAILED DESCRIPTION OF THE INVENTION

Figure 1:
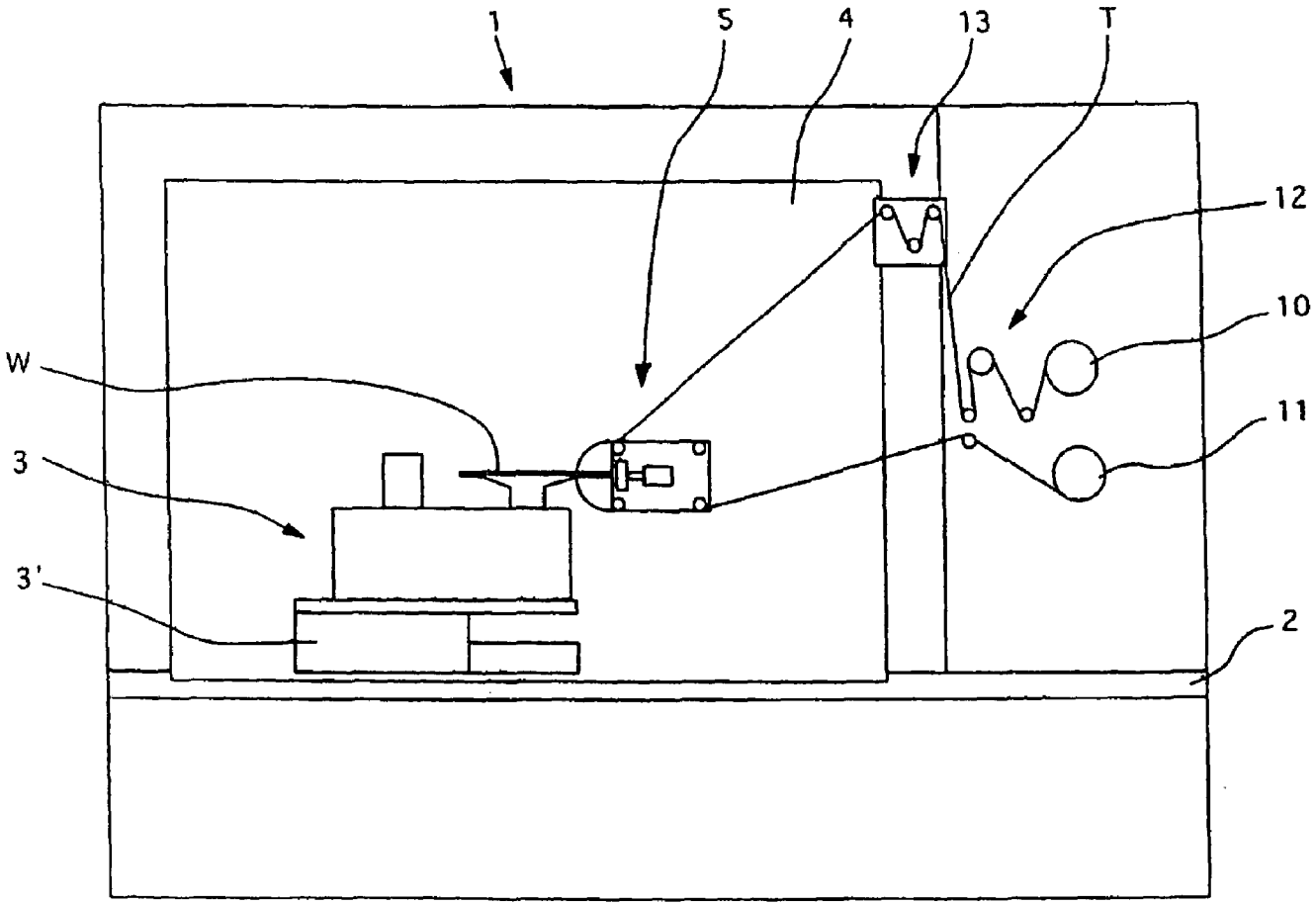
FIG. 1 is a schematic front view of a polishing machine embodying this invention.

FIG. 1 schematically shows a polishing machine 1 embodying this invention, having a moving device 3 on a horizontal table plate 2 for moving a target body W to be polished vertically, rotationally and horizontally, as will be explained more in detail below. A front plate 4 provided with a polishing head 5 is attached perpendicularly to the table plate 2. If necessary, pipes for supplying water that is required for the polishing and chemicals that may be used for chemical mechanical polishing may be attached to the front plate 4.

A supply roller 10 for supplying a polishing tape T and a take-up roller 11 for winding up the polishing tape are provided to another plate disposed at a side of the table plate 2. In addition, a feed roller 12 and an auxiliary roller 13 are provided. The feed roller 12 is for transporting the polishing tape T at a fixed speed. The auxiliary roller 13 is for preventing the polishing tape T from experiencing any excessively large stress as the polishing head 5 undergoes an oscillatory (reciprocating) motion.

Figure 2:
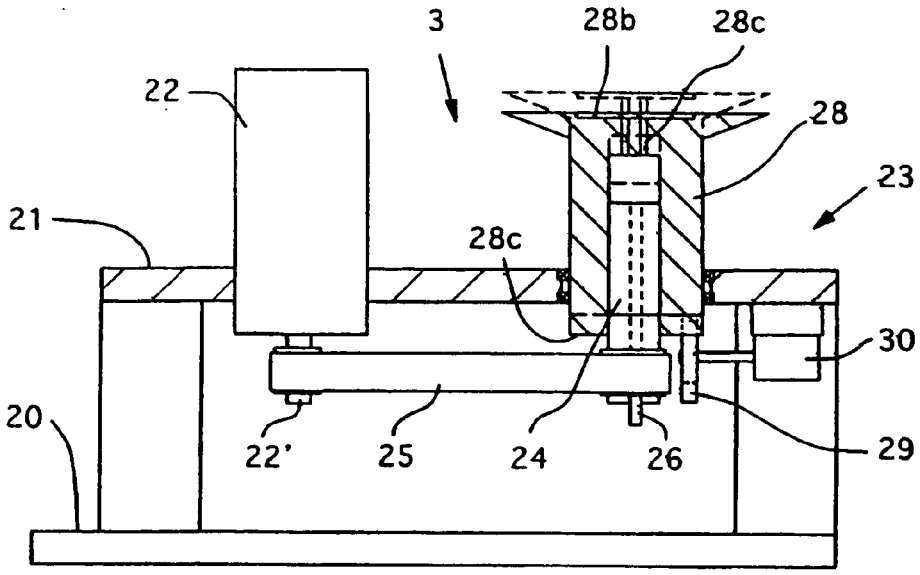
FIG. 2 is a partially broken front view of a moving device which is incorporated to the polishing machine of this invention.

With reference next to FIG. 2, the moving device 3 is attached to the table plate 2 through a device 3' shown in FIG. 1 for moving the moving device 3 horizontally in a reciprocating manner such that the polishing head can be moved to any position on the surface of the target body.

The moving device 3 has a cubic block frame 21 affixed onto a base 20 fastened to the device 3'. A motor 22 is attached to one side of this frame 21 with its shaft 22' in the vertical direction. A rotary device 23 is provided on the opposite side.

The rotary device 23 has at its center a rotary shaft part 24 which extends vertically and connects to the shaft 22' of the motor 22 through a belt 25. As the motor 22 is driven, the rotation of the shaft 22' is communicated to the rotary shaft part 24. A pipe 26 is buried inside this rotary shaft part 24 and is connected to an air discharge pump (not shown) so as not to impede its rotation.

A rotary support part 28, which is adapted to rotate with the rotary shaft part 24 while being movable in the direction of its axis, is rotatably supported by the frame 21 so as to be movable upward and downward. The rotary support part 28 is supported by a cam 29 in contact with its bottom surface 28*a*. Although a single cam is shown in the figure, similar cams may be provided whenever necessary. The cam 29 is connected to the shaft of another motor 30 so as to rotate as this motor 30 rotates, thereby moving upward or downward the bottom surface 28*a* with which it is in contact. The rotary support part 28 is thus moved upward or downward (as shown by broken lines in FIG. 1).

There is an indentation 28*b* formed on the upper surface of the rotary support part 28. A throughhole 28*c* is further provided to this upper surface. As air is discharged through the pipe 26, a condition of negative pressure is generated inside the indentation 28 through the throughhole 28*c* such that, if the target body is place thereon, it is supported at this position by a suction force.

Thus, the target body supported by the moving device 3 can be freely rotated and moved both in the right-left and vertical directions. Although the present invention relates to a device for polishing a disk-shaped target object such as a semiconductor wafer, the motors, the belt and the rotary shafts can be dispensed with in the case of a target body which need not be rotated. Although an example has been described above adapted to move a target body by means of the rotary support part and the rotary shaft part, the device 3' may be provided with the function of moving the moving device 3 as a whole in the vertical direction. In such a case, the rotary support part and the rotary shaft part may be integrated.

Figure 3A:
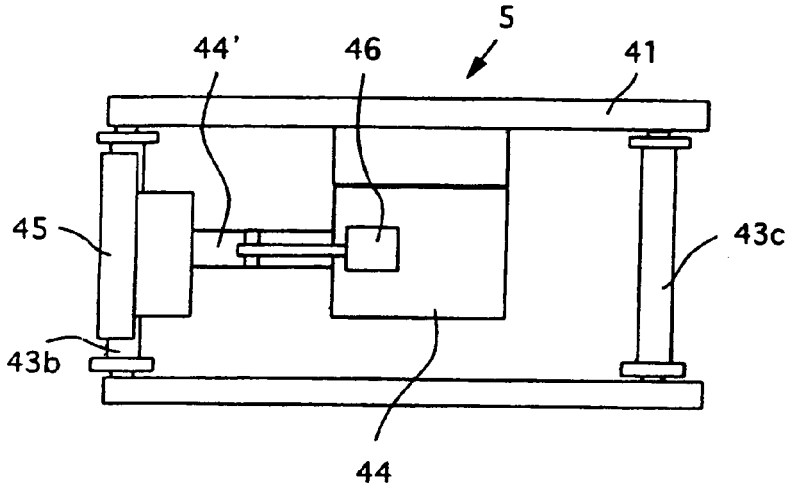
FIGS. 3A and 3B, together referred to as FIG. 3, show a polishing head incorporated to the polishing machine of this invention, FIG. 3A being its plan view and FIG. 3B being its front view, each with a few components removed for the convenience of disclosure.
Figure 3B:
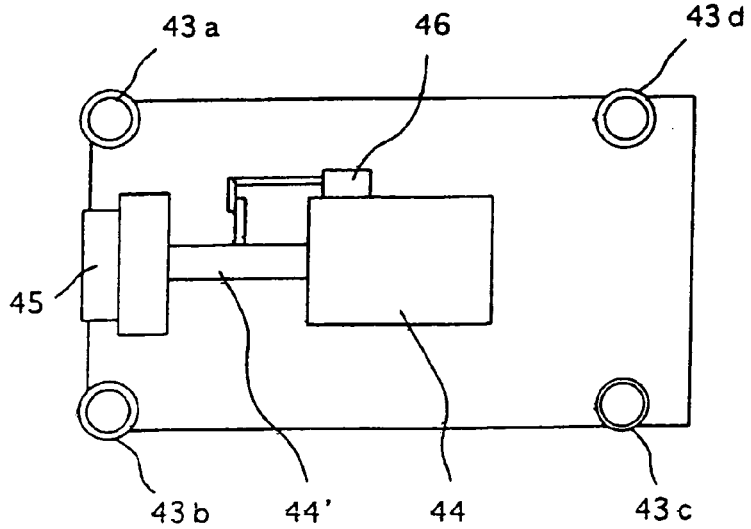

FIG. 3 shows the polishing head 5, FIG. 3A being its plan view (except that two of its rollers on the upper side are removed for the convenience of disclosure) and FIG. 3B being its front view (except that its forward plate is removed for the same reason). The polishing head 5 is provided with two mutually parallel plates 41 and 42 and freely rotatable rollers 43*a*, 43*b*, 43*c* and 43*d* disposed between them. An air cylinder 44 is provided at the center of the first plate 41, and a pad 45 is attached to the tip of a rod 44' of this air cylinder 44. As the air cylinder 44 is activated, its rod 44' is caused to protrude and retract. This serves to cause the paid 45 to push the polishing tape T forward to contact the target body. It now goes without saying that the air cylinder 44 may be replaced with any other means for causing the pad 45 to move forward and backward.

Figure 8:
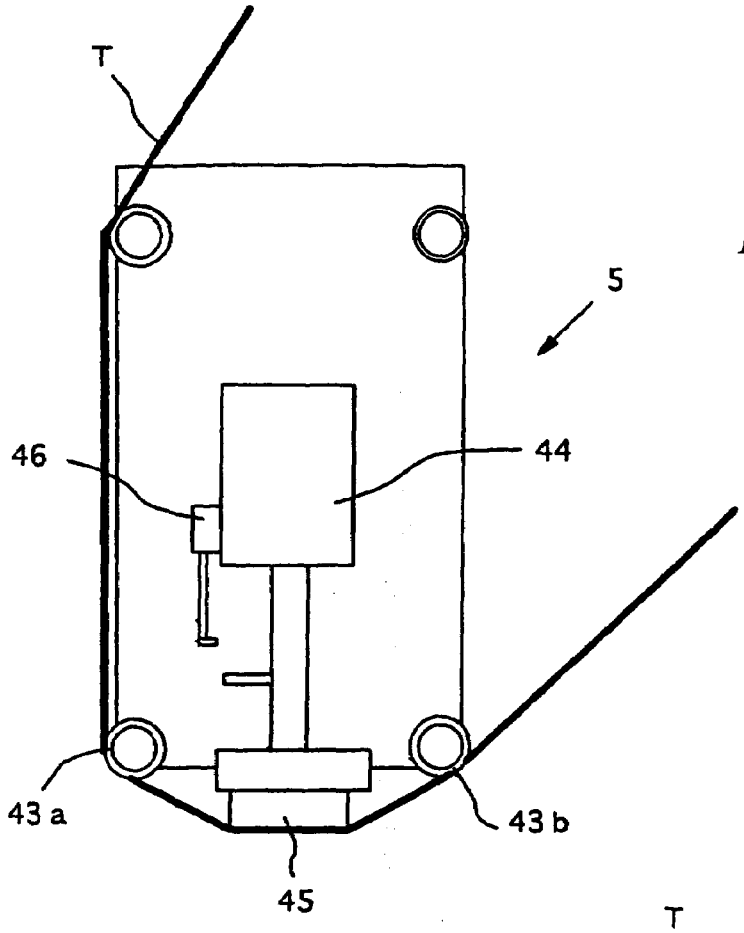
FIG. 8 shows the polishing head with the pad in a protruded condition.

A stopper 45 is provided to the air cylinder 44 such that the pad 45 will be prevented from moving forward unexpectedly. As the stopper 45 is activated, the rod part is rotated so as to become disengaged from a hook such that the rod 44' becomes able to be extended, as shown in FIG. 8.

Figure 4B:
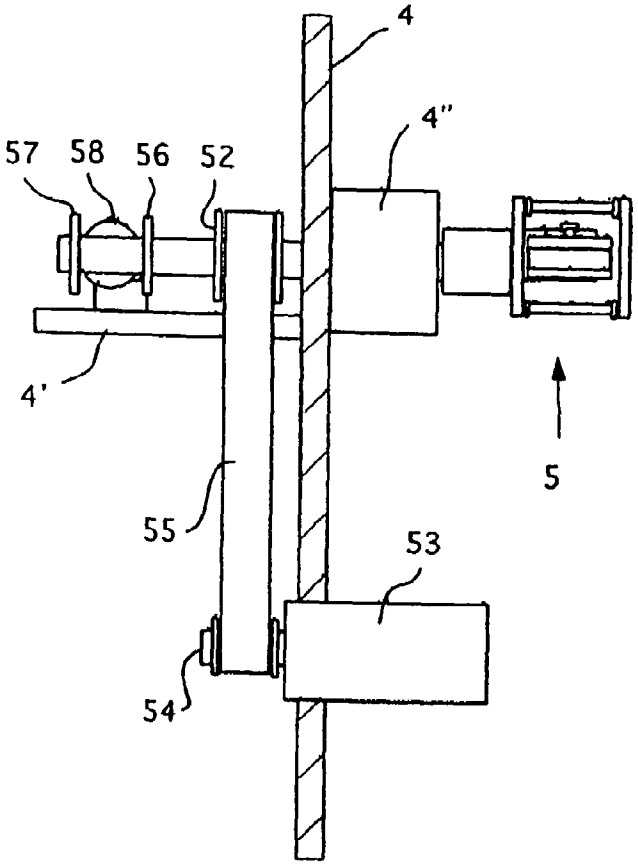
FIGS. 4A and 4B, together referred to as FIG. 4, show a rotary-and-reciprocating motion device incorporated to the polishing machine of this invention, FIG. 4A being its plan view and FIG. 4B being its side view, each with a few components removed for the convenience of disclosure.
Figure 4A:
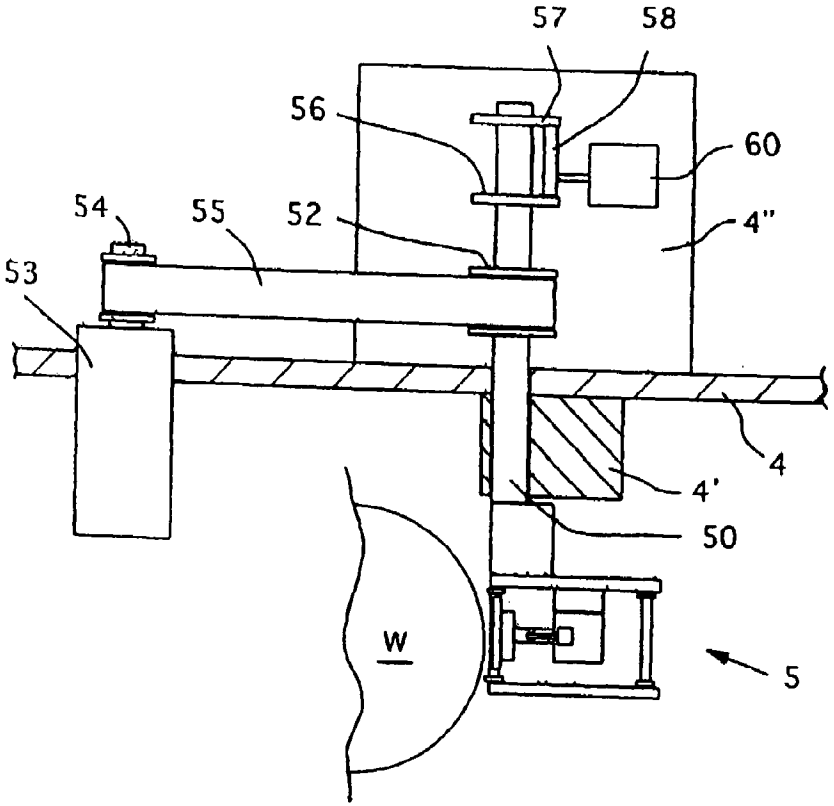

FIG. 4 shows a rotary-and-reciprocating motion device for causing rotational and reciprocating motions of the polishing head. A rotary shaft 50 is attached to the back surface of the plate 41 of the polishing head 5, extending along the mutually contacting part of the target body W and the polishing tape T stretched between the rods 43 and 43' and perpendicularly penetrating an auxiliary block 4' and the front plate 4. The auxiliary block 4' and the front plate 4 both support the rotary shaft 50 rotatably so as to be movable in its axial direction.

A rotary member 52 which contains the rotary shaft 50 at the center, supporting it so as to be movable in its axial direction and is adapted to rotate therewith, is attached to the rotary shaft 50. It is connected to the shaft 54 of still another motor 53 through a belt 55. Thus, as the motor 53 is activated and its shaft 54 is rotated, this rotary motion is communicated through the belt 55 to the rotary member 52 and the rotary shaft 50 is rotated.

Figure 5:
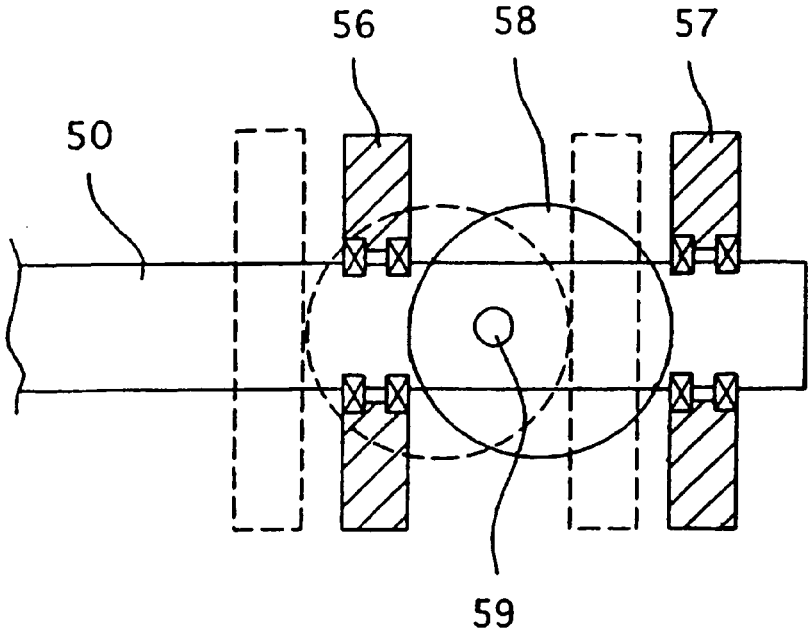
FIG. 5 is an enlarged drawing of an end part of the rotary shaft of the rotary-and-reciprocating motion device shown in FIG. 4.

As shown in FIG. 5 more in detail, there are two rotary plates 56 and 57 attached to an end portion of the rotary shaft 50 so as to be mutually parallel and perpendicular to the axial line of the rotary shaft 50. These two rotary plates 56 and 57 are rotatable with respect to the rotary shaft 50 but not movable in its axial direction. A circular cam 58 is disposed between and in contact with these rotary plates 56 and 57. The shaft of a cam motor 60 attached to a support plate 4" is connected to an eccentric position 59 (displaced from the center) of the cam 58. Thus, as the cam motor 60 is rotated, the cam 58 rotates around its eccentric position 59. As the two rotary plates 56 and 57 also rotate, since they are themselves prevented from moving in the axial direction of the rotary shaft, the rotary shaft 50 is caused to move in its axial direction. In other words, the rotation of the cam motor 60 causes a reciprocating motion of the rotary shaft 50 in its axial direction, causing the polishing head 5 attached to the rotary shaft 50 to also undergo an oscillating (reciprocating) motion.

The operations of the polishing machine according to this invention will be described next for a situation when a beveled part and an edge part of a semiconductor wafer are polished thereby.

Figure 6:
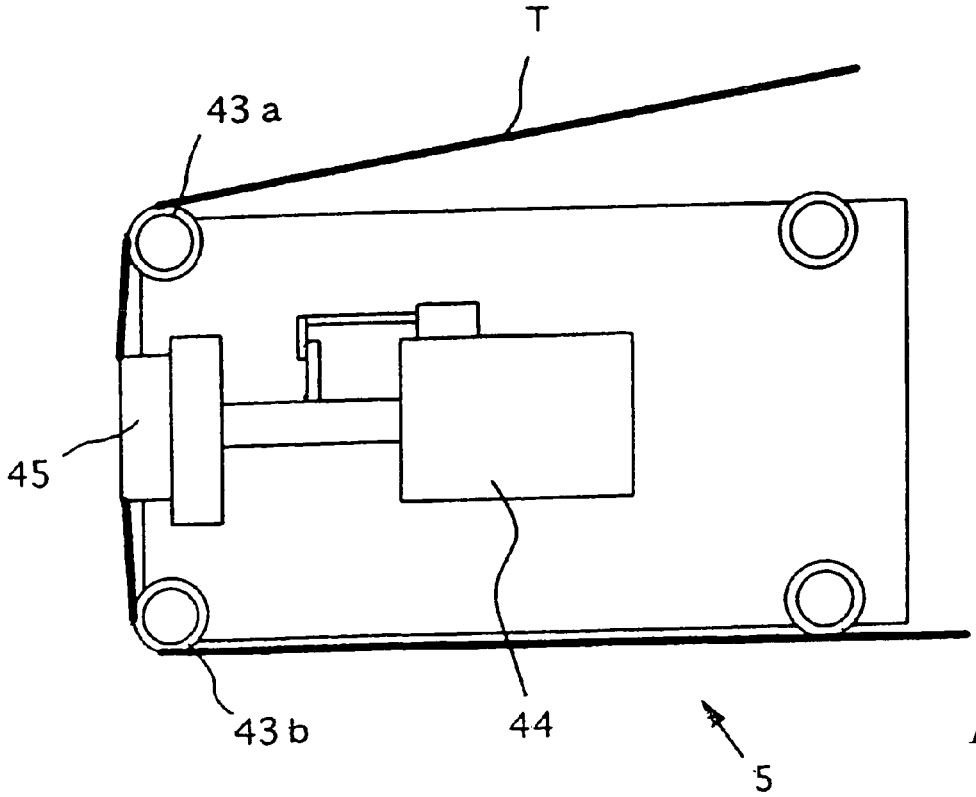
FIG. 6 is a front view of the polishing head with the polishing tape.

The polishing tape T is passed to the polishing head 5 as shown in FIGS. 1 and 6, and a semiconductor wafer W is placed on the upper surface of the rotary support part 28 of the rotary device 23. The interior of the indentation 28*b* is in a negative-pressure condition by the pipe 26, as explained above, such that the semiconductor wafer W is supported by suction.

As the de vice 3' is activated, an end part of the semiconductor wafer W on the rotary support part 28 moves horizontally so as to contact the polishing tape T on the pad 45 of the polishing head. As the cam 29 is rotated to cause the rotary support part 28 to move vertically such that the contacting part of the end part of the semiconductor wafer W with the polishing tape T on the pad 45 will come onto the axial line of the rotary shaft 50. During this time, the stopper 46 serves to control the motion of the rod 44' such that the pad 45 will be prevented from protruding in an unexpected manner.

Figure 7A:
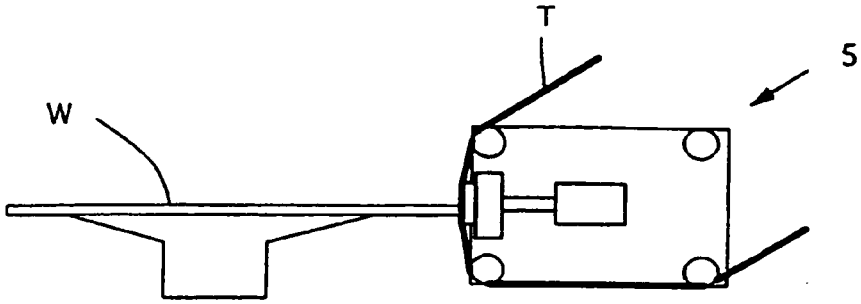
FIGS. 7A, 7B and 7C, together referred to as FIG. 7, are drawings for showing the oscillating motion of the polishing head in contact with a semiconductor wafer.
Figure 7B:
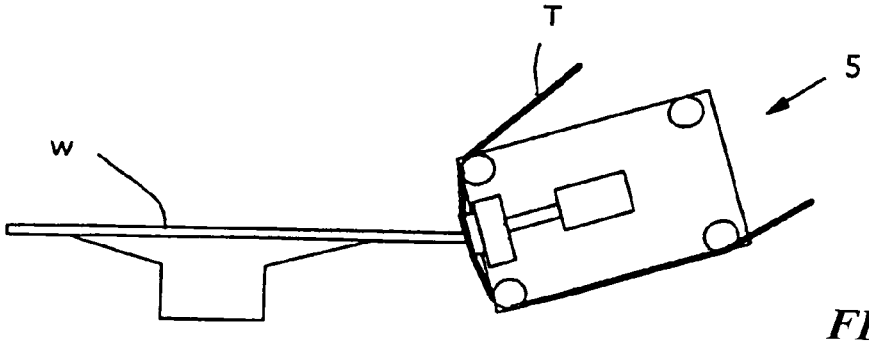
Figure 7C:
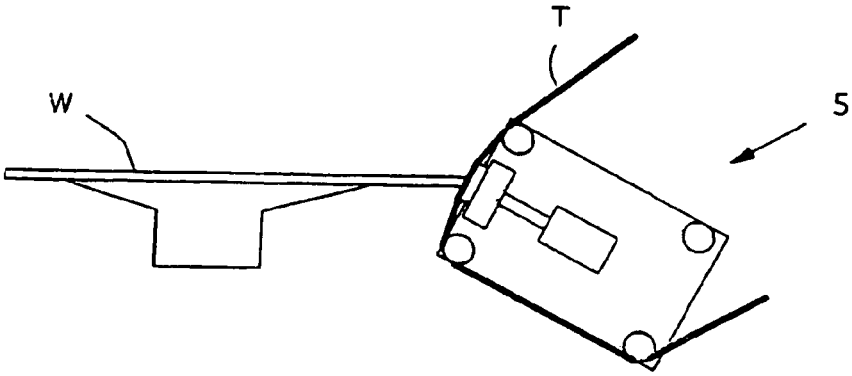
Figure 10A:
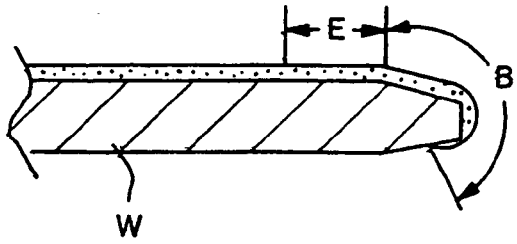
FIG. 10A is a sectional view of a portion of a semiconductor wafer with its beveled part covered with a thin film.

In order to remove the thin film from the beveled part B on the semiconductor wafer as shown in FIG. 10A, the rotary shaft part 24 and the rotary support part 28 are rotated by the motor 22 for rotating the semiconductor wafer W. At the same time, the motor 53 is activated to rotate the rotary member 52 and the rotary shaft 50. As the rotary shaft 50 is rotated, the rotary head 5 is also caused to rotate as shown in FIG. 7. After the rotary shaft 50 rotates by a specified angle, the direction of motion of the motor 53 is reversed and the rotary shaft 50 also reverses its direction of rotation. As the rotary shaft 50 repeatedly changes its direction of rotation, the polishing head 5 undergoes an oscillatory motion as shown in FIG. 7. Since the polishing tape T continues to be supplied and wound up in the meantime, a new portion of the polishing layer is used for the polishing.

Figure 10B:
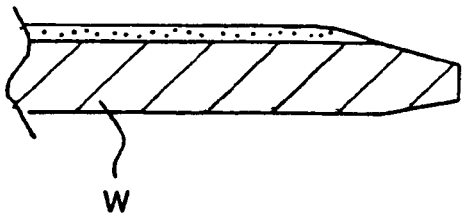
FIG. 10B is a sectional view of the semiconductor wafer after the thin film has been removed from its beveled part.

The rotary shaft 50 undergoes a reciprocating motion also in the axial direction by the motion of the cam motor 60, causing to oscillate the polishing head 5 such that the entire width of the polishing tape T contributes to the polishing. In other words, the polishing tape T is more effectively used by this motion. As a result, the thin film on the beveled part B of the semiconductor wafer W can be removed as shown in FIG. 10B. During this polishing operation, the polishing tape T is not caused to bend excessively and the generation of particles and contamination caused by the separation of the polishing layer from the polishing tape T can be prevented.

For removing the thin film from the edge part E of the semiconductor wafer W, the motor 53 is operated to rotate the rotary member 52 to bring the polishing head 5 into a perpendicular position. The stopper 46 is activated to allow the rod 44' to extend. The air cylinder 44 is activated such that the pad 45 comes to protrude as shown in FIG. 8.

Figure 9:
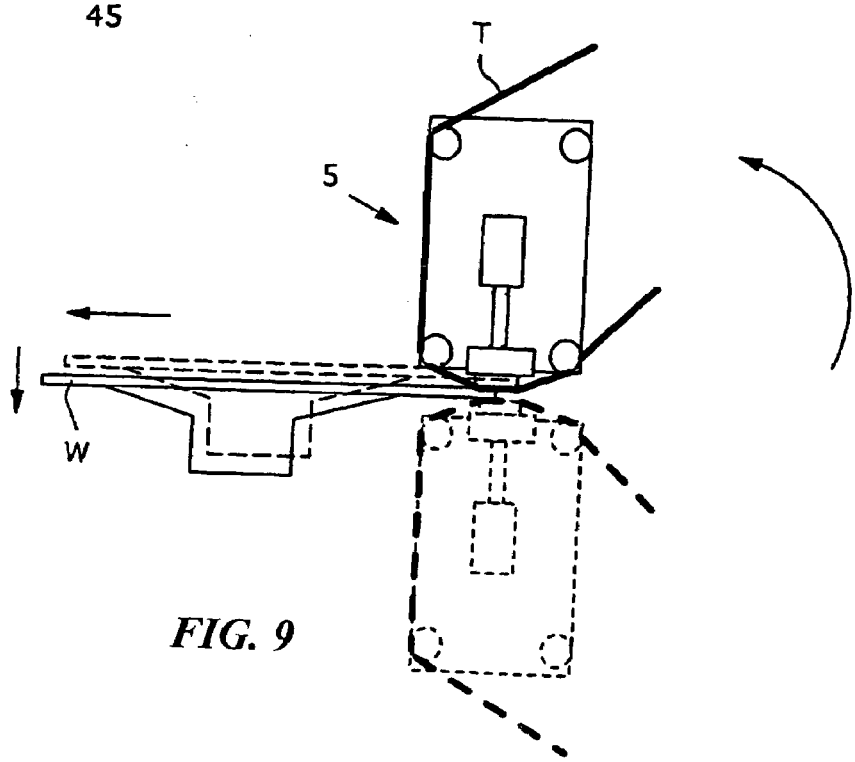
FIG. 9 shows a situation where the polishing head contacting the semiconductor wafer which has been moved backward and downward.
Figure 11A:
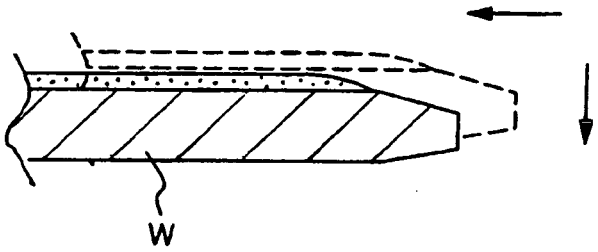
FIG. 11A shows a semiconductor wafer which has been retracted backward and moved downward for having the thin film removed from its edge part.
Figure 11B:
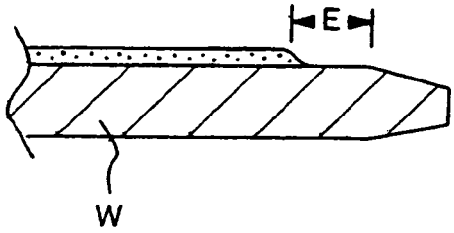
FIG. 11B shows the semiconductor wafer after the thin film has been removed from its edge part.

When the pad 45 is in this protruding condition, the edge of the semiconductor wafer and the pad 45 interfere in their motions, as shown in FIG. 9 (broken lines). Thus, the semiconductor wafer W is retracted and lowered, as shown in FIG. 11A. For this purpose, the moving device 3 is moved backward by means of the device 3' and the cam 29 is rotated so as to move the rotary support part 28 downward. As the polishing tape T is arranged to contact the edge part of the semiconductor wafer W as shown in FIG. 9, the polishing tape T is supplied and wound up, and the cam 58 is rotated to cause the oscillatory motion of the polishing head 5. The thin film is thus removed from the edge part E, as shown in FIG. 11B.

Although the pad 45 is caused to protrude as described above, the polishing layer is not separated, unlike in the situation with prior art polishing machines. Moreover, since the pad 45 causes the polishing tape T to protrude, the edge part can be made sharp as shown in FIG. 11B.

When the lower surface of the semiconductor wafer W is to be polished, an extra polishing head is provided as shown in FIG. 9 by broken lines such that both the upper and lower surfaces of the semiconductor wafer W can be polished at the same time.

With the moving device, the semiconductor wafer W can be conveniently moved in the horizontal direction such that the edge part can be appropriately positioned.

It goes without saying that the example described above is not intended to limit the scope of the invention. For example, the target body to be polished need not be a semiconductor wafer. The present invention can be applied equally well to the polishing of a glass substrate to remove foreign substances from its edge parts. At the time of a mechanical chemical polishing process, a tape without a polishing layer may be used.

What is claimed is:

1. A polishing machine that uses a polishing tape, said polishing machine comprising:

a polishing head for contacting said polishing tape to a disk-shaped target object to be polished;

a pad that is movably provided to said polishing head and serves to press said polishing tape onto said target object;

a rotary shaft that is connected to said polishing head in a direction of contact surface between said polishing tape and said target object;

a rotary-and-reciprocating motion device adapted to rotate said polishing head around the axial line of said rotary shaft and to move said polishing head reciprocatingly along said axial line; and a moving device adapted to undergo a reciprocating motion perpendicularly to said target object while supporting said target object;

wherein said moving device includes a rotating device for rotating said target object around the center thereof, said rotating device having a rotary shaft part that is rotated by a driving part and a rotary support part that contains said rotary shaft part inside and has a support surface for supporting said target object, said rotary support part rotating with said rotary shaft part and engaging said rotary shaft so as to be movable axially, said rotary-and-reciprocating motion device rotating said polishing head and said moving device moving said target object when said contact surface of said target object is polished such that said pad is moved outward to cause said polishing tape to protrude and to thereby come to contact said target object over said contact surface.

2. The polishing machine of claim 1 wherein said polishing tape comprises a base sheet material and a polishing layer formed on said base sheet material.

3. The polishing machine of claim 1 wherein said moving device is adapted to move said target object parallel to said contact surface to thereby adjust position of said contact surface with respect to said polishing tape.

4. The polishing machine of claim 1 including means engaged with a bottom part of said rotary support part for moving said rotary support part reciprocatingly in a direction perpendicular to said support surface.

5. The polishing machine of claim 4 wherein said means includes a cam that engages with said bottom part and a cam rotating means for rotating said cam.

6. The polishing machine of claim 1 wherein said rotary-and-reciprocating motion device includes a rotary member that contains said rotary shaft inside so as to be movable in an axial direction and is rotatable together with said rotary shaft by a rotating means, and wherein said rotary shaft is provided with means for moving said rotary shaft reciprocatingly in an axial direction.

7. The polishing machine of claim 6 wherein said means is not movable along the axis of said rotary shaft and wherein said means comprises two rotary plates which are rotatable, a cam which is positioned between and in contact with said two rotary plates and a rotary driver for rotating said cam.

8. The polishing machine of claim 1 wherein said polishing head includes two mutually parallel plates and a roller that is rotatably supported between said two plates, said polishing tape being adapted to run over said roller and said pad being adapted to move by an air cylinder provided to at least one of said plates.

* * * * *